US005740678A

United States Patent [19]

Lee et al.

[11] Patent Number: 5,740,678

[45] Date of Patent: Apr. 21, 1998

[54] IMPINGEMENT JET FREEZER AND METHOD

[75] Inventors: Ron C. Lee, Bloomsbury; Michael K. Sahm, Annendale, both of N.J.

[73] Assignee: The BOC Group, Inc., New Providence, N.J.

[21] Appl. No.: 449,456

[22] Filed: May 24, 1995

[51] Int. Cl.[6] ..... F25D 13/06

[52] U.S. Cl. ..... 62/63; 62/374; 62/384

[58] Field of Search ..... 62/374, 63, 384

[56] References Cited

U.S. PATENT DOCUMENTS

| | | | |
|---|---|---|---|
| 4,336,694 | 6/1982 | Schmitt et al. | 62/374 |
| 4,373,344 | 2/1983 | Hinn | 62/388 |
| 4,399,658 | 8/1983 | Nielsen | 62/388 |

*Primary Examiner*—Ronald C. Capossela

*Attorney, Agent, or Firm*—David M. Rosenblum; Larry R. Cassett

[57] ABSTRACT

An impingement freezer having a zoned freezing chamber in which the temperature of each zone is independently controllable so that the temperature profile within the impingement freezer is coldest at a zone adjacent the outlet and warmest at a zone adjacent the inlet for maximum thermodynamic usage of the refrigerant. Additionally, the velocity of each of the impingement jets is independently adjustable from zone to zone so that in the zone adjacent the entrance of the freezing chamber, the impingement jets can be adjusted to have maximum velocity to produce maximum heat transfer coefficients and thereby an acceptable rate of cooling within the impingement jet freezer. Impingement jets are formed within nozzles that are tapered in two orthogonal directions to prevent frost build-up. Circulation within the impingement jet freezer is produced by venturi-like devices driven by vaporization of incoming refrigerant.

19 Claims, 2 Drawing Sheets

IMPINGEMENT JET FREEZER AND METHOD

BACKGROUND OF THE INVENTION

The present invention relates to an impingement freezer and freezing method in which jets of refrigerant are directed against articles within a freezing chamber. More particularly, the present invention relates to such an impingement freezer in which the freezing chamber has freezing zones in which the mass flow rates of the impingement jets produced in each of the zones can be adjusted independently of the mass flow rates of the impingement jets in the other remaining zones.

Commercial freezers operate by direct heat transfer from articles to be refrigerated or frozen to a refrigerant such as cooled air or a vaporized liquified gas, for instance, vaporized liquid nitrogen. Typically, such freezers consist of a freezing chamber or tunnel through which the articles to be refrigerated are conveyed by a conveyor belt. In many designs, cold gaseous nitrogen is circulated throughout the length of the freezing chamber by means of fans.

The articles entering the freezing chamber have a boundary layer composed primarily of stagnant air. This boundary layer acts to insulate the articles from the refrigerant. In order to minimize the thickness of such boundary layer and therefore optimize the utilization of the refrigerant, impingement jet freezers have been developed such as illustrated in European Patent Application 0 612 966A1. In impingement jet freezers jets of the refrigerant impinge on the articles. These impingement jets are formed by allowing a pressured refrigerant to escape from impingement jet openings formed between a plurality of parallel, elongated channel-like members. The forced convective flow that is directed through the impingement openings produces multiple columns of high velocity gas jets that impinge in a perpendicular direction to the product surface. In this manner, high heat transfer coefficients are possible in the stagnation region near the impingement points. In order to reduce the insulating effect of the thick boundary layer, multiple impingement jets are utilized in such a fashion that a large number of impingement flow cells are created producing relatively thin thermal boundary layers.

In any freezing application in which a refrigerant, such as a liquid cryogen, is continually being expended, there exists a need to optimize the refrigerant usage. In an impingement freezer, this normally represents a trade off between high exhaust temperatures and the maintenance of the sufficiently high impingement jet velocities that are required to produce high heat transfer coefficients and therefore, acceptable freezing rates. In addition to the foregoing, the use of fans and motors can represent up to 30% of the heat load in any freezer.

As will be discussed, the present invention provides an impingement jet freezer in which the temperature and convective heat transfer coefficient profiles are controllable within the freezer to more efficiently utilize the refrigerant. Moreover, efficiencies are realized by preferred embodiments that do not utilize thermal loading devices such as motorized fans or blowers.

SUMMARY OF THE INVENTION

The present invention provides an impingement freezer comprising a freezing chamber having an inlet for receiving articles to be refrigerated, an outlet for discharging the articles after having been refrigerated. A means is provided for conveying articles from the inlet to the outlet and at least two zones are provided that include an inlet zone located adjacent the inlet and an outlet zone located adjacent the outlet. Each of the at least two zones have impingement nozzle means for directing at least one refrigerant jet against the articles to be refrigerated. A circulation means is connected to the impingement nozzle means for drawing the refrigerant from the freezing chamber after having exchanged heat with the articles into a mixture with the incoming refrigerant and for discharging the mixture into the impingement nozzle means. The circulation means is driven by the at least partially vaporized incoming refrigerant. A control means is provided for independently controlling flow rate of the incoming refrigerant to the circulation means of said at least two zones. A vaporizer means is positioned within the freezing chamber to exchange heat between the incoming refrigerant and the refrigerant drawn by said circulation means of at least one of the two zones for at least partially vaporizing the incoming refrigerant. A distribution means is connected to the vaporization means and the control means for distributing the incoming refrigerant from the vaporization means to the control means.

In accordance with another aspect of the present invention, a method of refrigerating articles is provided in which the articles are passed through a freezing chamber in a direction taken from the inlet to the outlet of the freezing chamber. Impingement jets of refrigerant are directed against the articles so that the refrigerant warms to form heated refrigerant and the articles cool through direct heat transfer between the refrigerant and the articles. The impingement jets are directed against the articles within at least two zones of the refrigeration chamber. The at least two zones include an inlet zone located adjacent to the inlet of the freezing chamber and an outlet zone adjacent to the outlet of the freezer. The incoming refrigerant is at least partially vaporized through heat transfer with the heated refrigerant and first and second portions of the incoming refrigerant, after having been at least partially vaporized, are delivered to the outlet and inlet zones, respectively. The heated refrigerant is drawn from the inlet and outlet zones by expending work from the at least partly vaporized incoming refrigerant. The heated refrigerant is mixed with the first and second portions of the incoming refrigerant. The impingement jets of the outlet and inlet zones are formed from mixtures of the heated refrigerant and the first and second portions of the incoming refrigerant, respectively. It should be mentioned that the foregoing description of the present invention is not meant to exclude the fact that there is some transfer of refrigerant between zones and that, for instance, the second mixed refrigerant stream would in practice be partly formed from refrigerant drifting from the outlet zone to the inlet zone.

In still another aspect, the present invention provides an impingement freezer comprising a freezing chamber having an inlet for receiving articles to be refrigerated and an outlet for discharging the articles after having been refrigerated. A means is provided for conveying the articles from the inlet to the outlet. At least a first plurality of impingement nozzles are provided for directing refrigerant jets against the articles to be refrigerated. At least one ejector is provided having a high pressure inlet for receiving the incoming refrigerant stream, a low pressure inlet for drawing the refrigerant from the freezing chamber after having exchanged heat with the articles into a mixture with the incoming refrigerant, and a high pressure outlet for discharging the mixture into the impingement nozzle. A vaporization means is in communication with the high pressure inlet of the at least one ejector for at least partially vaporizing the incoming refrigerant and for discharging the incoming refrigerant to the ejector. The vaporization means is positioned within the freezing chamber between the articles and the low pressure inlet so that the refrigerant after having cooled the articles and having itself become heated, transfers heat to the incoming refrigerant before being drawn into the mixture.

An advantage of the present inventions set forth in the first two aspects mentioned above is that the mass flow rate of incoming refrigerant to each zone can be or is regulated or controlled. This in turn allows for control of the convective heat transfer coefficient of each zone and therefore the degree of refrigeration imparted to each zone. For instance, an impingement freezer in accordance with the present invention can be operated in a mode in which a cryogenic refrigerant enters a vaporizer within the outlet zone and during vaporization passes in a heat exchanger toward the inlet zone or counter-currently to the articles to be frozen. It is to be noted that one efficiency realized in any embodiment constructed or operated in accordance with the present invention is that such vaporization occurs within the freezing chamber so that there is no loss in cooling potential in vaporizing incoming refrigerant, for instance, a liquid cryogen such as liquid air, nitrogen or other liquefied atmospheric gas. Such a vaporization could be conducted in a series of vaporizers located in the zones of the freezer which would thereby be amenable to be operated with the outlet zone having the lowest temperature and with temperatures increasing in each succeeding zone towards the inlet zone. In a particularly preferred embodiment of the present invention, the inlet zone is not provided with a vaporizer to produce still even warmer temperatures in the inlet zone, where the exhaust would be located.

Thus, a typical counterflow temperature profile can be set up within an impingement freezer of the present invention in which the coldest temperatures are located at the outlet of the freezer and the warmest temperatures located at the inlet of the freezer. As a result, the temperature of a refrigerant such as liquid nitrogen vaporized within the freezer when vented or exhausted will be greater than in prior art designs to allow for a more efficient usage of the refrigerant.

In such a preferred impingement freezer or freezing operation, the amount of refrigerant entering each zone can be balanced with greater mass flow rates of refrigerant to the impingement nozzles at the inlet end of the freezer as compared with the outlet end of the freezer. Thus, the heat transfer coefficients can be maximized at the warmest temperatures to produce acceptable freezing rates.

The last mentioned aspect of the present invention, set forth above, calls for the use of ejectors. It is to be noted that the present invention, in other aspects, also encompasses the use of other venturi-like devices known in the art. This further enhances thermal efficiency of an impingement jet freezer in accordance with the present invention by utilizing the thermal energy of the articles to be refrigerated to drive the convective flow and thereby eliminate the additional heat load due to the work of fans or blowers. It is to be noted that the present invention contemplates the use of supplemental fans or blowers. In such case the use of ejectors or other venturi-like devices will reduce the potential heat load.

In a yet still further aspect, the present invention provides an impingement freezer comprising a freezing chamber having an inlet for receiving articles to be refrigerated, an outlet for discharging the articles after having been refrigerated. A means is provided for conveying articles from the inlet to the outlet. A plurality of nozzles are provided for directing jets of refrigerant against an article to be refrigerated within an impingement jet freezer. One problem with impingement jet freezers, particularly in the case of cryogenic refrigerants, is that frost tends to accumulate within the impingement jet nozzles. In order to minimize the problem of frost build-up, a nozzle in accordance with the present invention comprises an elongated body having a proximal end and a distal end located opposite the proximal end. The elongated body is tapered in two transverse, cross-sectional orthogonal directions from the proximal end to the distal end. This two dimensional tapering of the nozzle acts to inhibit frost build-up and accumulation.

As used herein and in the claims, the term "refrigerate" means to cool articles. The term includes anything from a temperature drop to a complete freezing of the articles. The term "refrigerant" as used herein and in the claims includes cryogenic refrigerants formed from any liquefied atmospheric gas or liquid air itself.

BRIEF DESCRIPTION OF THE DRAWINGS

Although the specification concludes with claims distinctly pointing out the subject matte that Applicants regard as their invention, it is believed that the invention would be better understood when taken in connection with the accompanying drawings in which;

DETAILED DESCRIPTION

Figure 1:
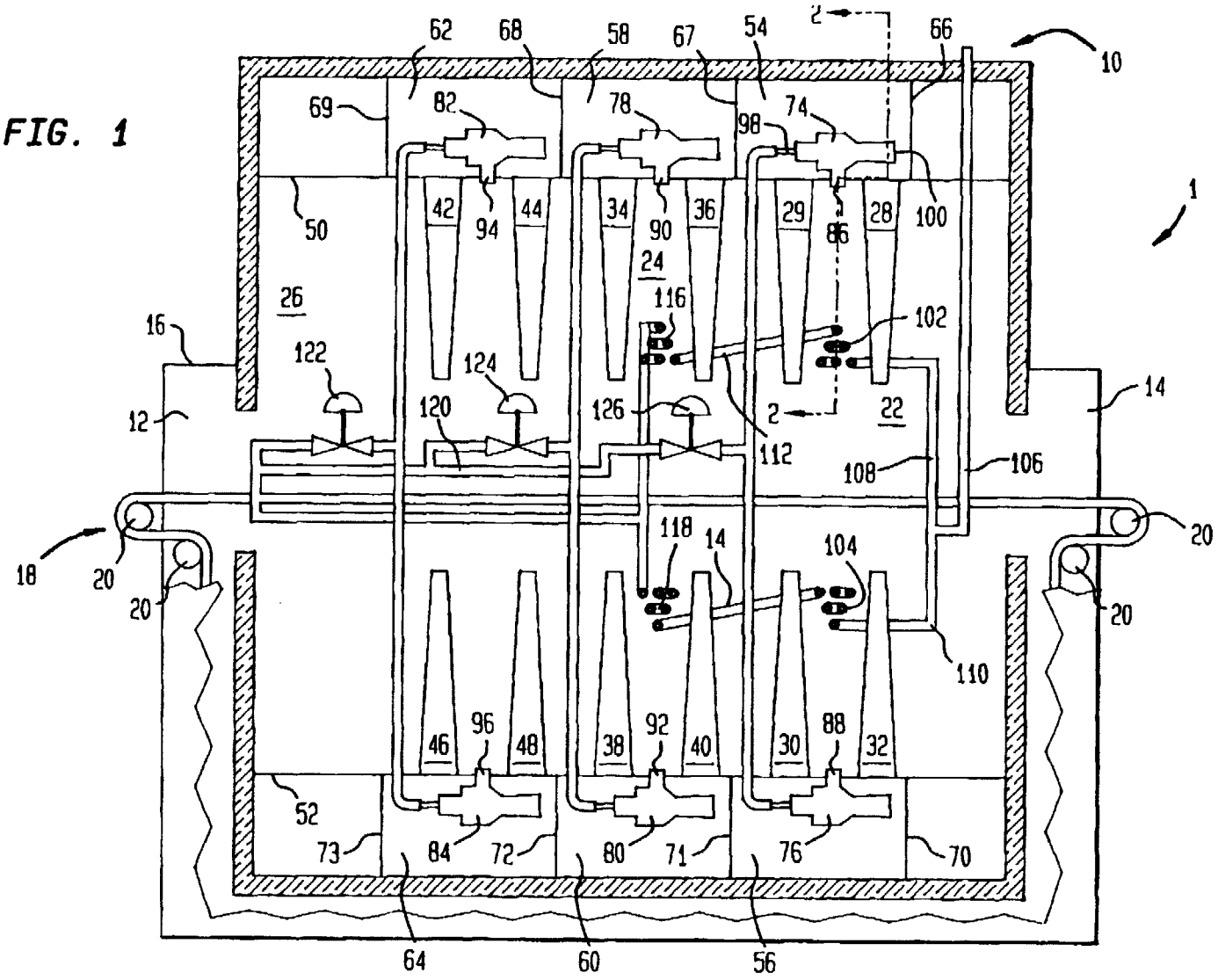
FIG. 1 is a schematic view of an impingement jet freezer in accordance with the present invention.
Figure 2:
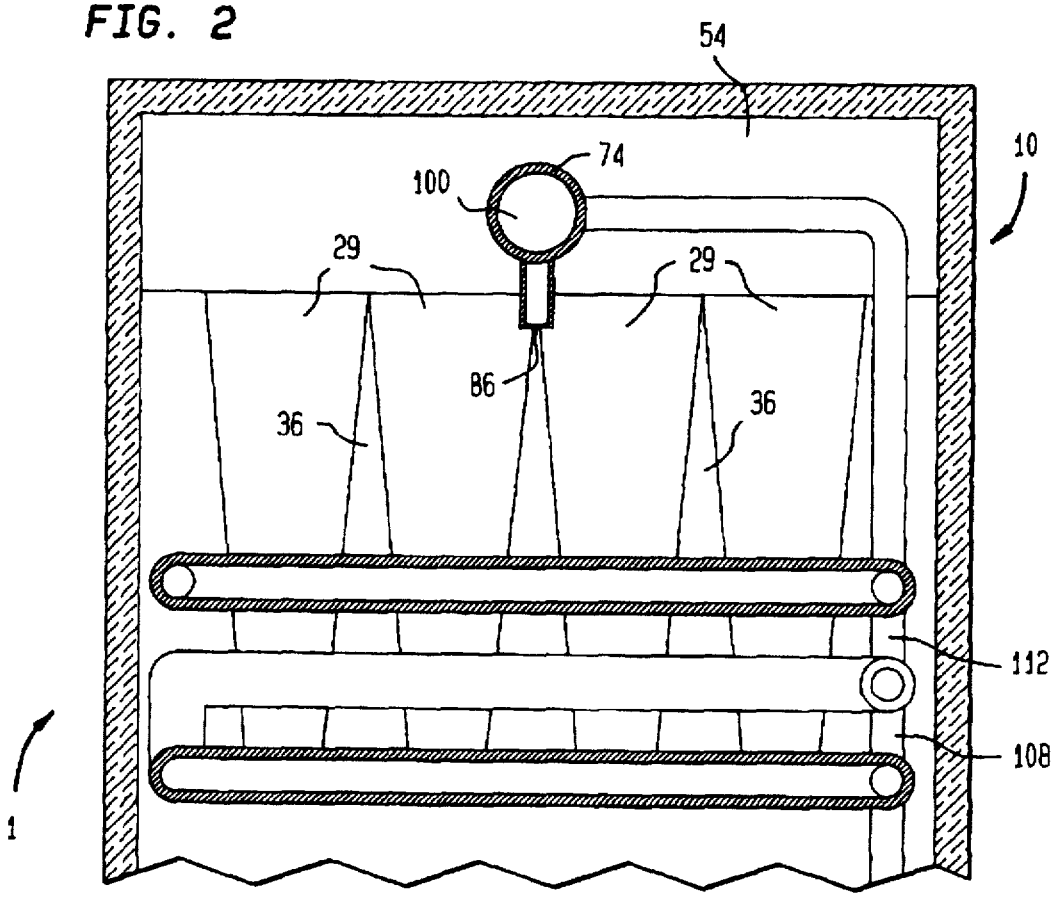
FIG. 2 is a sectional view taken along line 2—2 of FIG. 1.

With reference to FIGS. 1 and 2 an impingement jet freezer 1 in accordance with the present invention as illustrated. Impingement jet freezer 1 is provided with a freezing chamber 10 having an inlet 12 for receiving articles to be refrigerated and an outlet 14 for discharging the articles after having been refrigerated. An open portion 16 of the entry vestibule of impingement jet freezer 1 is provided for venting refrigerant that has been used in freezing the articles. A porous conveyor belt 18 conveys the articles from inlet 12 to outlet 14. Porous conveyor belt 18 is mounted on rollers 20 that are motorized to impart motion to porous conveyor belt 18.

Impingement jet freezer 1 has three zones which include an outlet zone 22 adjacent outlet 14 and intermediate zone 24 adjacent outlet zone 22 and an inlet zone 26 adjacent the inlet zone so that intermediate zone 24 is situated between outlet zone 22 and inlet zone 26. As will be become apparent from the discussion below, an impingement jet freezer in accordance with the present invention could have, at minimum, two zones or could have more than three zones.

Outlet zone 22 has two rows of upper impingement jet nozzles 28 and 29 and two lower rows of lower impingement jet nozzles 30 and 32. As can be appreciated, larger freezers would employ more rows of impingement jet nozzles. Intermediate zone 24 similarly has two rows of upper impingement jet nozzles 34 and 36 and two rows of lower impingement jet nozzles 38 and 40. Lastly, inlet zone 26 has two rows of upper impingement jet nozzles 42 and 44 and two rows of lower impingement jet nozzles 46 and 48. The aforementioned upper and lower rows of impingement jet nozzles 28–48 are respectively connected to upper and lower baffle plates 50 and 52. Freezing chamber 10 in spaces located above upper baffle plates 50 and below lower baffle plates 52 are further subdivided into three sets of upper and lower compartments associated with outlet, intermediate, and entry zones 22–26. These upper and lower compartments are respectively designated by reference numerals 54, 56; 58, 60; and 62, 64. Upper compartments 54, 58 and 62 are defined between partitions 66 through 69 and lower compartments 56, 60 and 64 are defined between partitions 70 through 73. Refrigerant is introduced into compartments 54–64 and therefore impingement nozzles 28–48 to direct impingement jets against articles being carried through freezing chamber 10 upon conveyor belt 18.

Mounted within compartments 54–64 are upper and lower ejectors 74 and 76 associated with outlet zone 22, upper and lower ejectors 78 and 80 associated with intermediate zone 24, and upper and lower ejectors 82 and 84 associated with inlet zone 26. Ejectors 74–84 are mounted within respective compartments 54–64 and are connected to upper and lower baffle plates 50–52 via their low pressure inlets 86 through 96, respectively. Each of the ejectors 74–84 are also provided with a high pressure inlet 98 such as illustrated for ejector 74 and high pressure outlet 100 such as also illustrated for ejector 74. As a result, each ejector through its high pressure outlet introduces refrigerant at a high pressure into compartments 54–64. This is turn causes impingement jets to be formed within impingement jet nozzles 28–48 which are in turn directed against the articles to be refrigerated. After the refrigerant has cooled the article and has itself become heated to form heated refrigerant, it is drawn into low pressure inlet 86 such as illustrated for ejector 74 to mix with incoming refrigerant. This mixture is used to form the impingement jets of outlet zone 22.

As can be appreciated by those skilled in the art that since outlet, intermediate and inlet zones 22–26 are not isolated from one another, the heated refrigerant can also drift in a counter-current direction taken from outlet zone 22 to inlet zone 26 and as such, some heated refrigerant drawn in any zone to any ejector thereof will not have originated in the particular zone under consideration. It should be noted that the present invention is not limited to the use of ejectors. For instance, other venturi-like devices could be applicable as well as supplemental fans or blowers.

Figure 3:
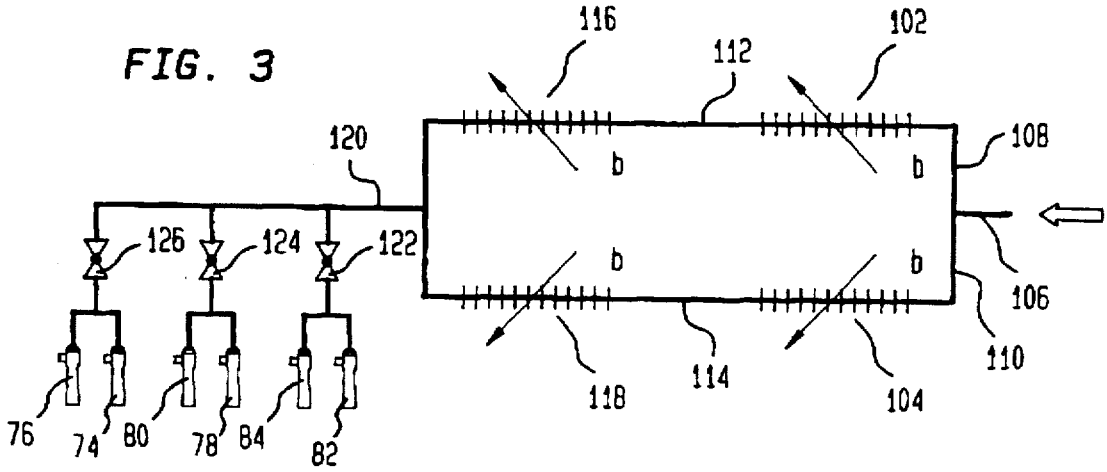
FIG. 3 is a schematic view of the connection of vaporizers and ejectors utilized within the impingement jet freezer of FIG. 1.

With additional reference to FIG. 3, the incoming refrigerant which is preferably liquid nitrogen, first enters a pair of upper and lower vaporizers 102 and 104. Each of the upper and lower vaporizers 102 and 104 are formed from a bundle of six pipes which are connected end to end. Other vaporizer configurations are possible. The liquid nitrogen enters an inlet pipe 106 and then flows into upper and lower vaporizers 102 and 104 by way of branch pipes 108 and 110. The liquid nitrogen is at least partially vaporized within upper and lower vaporizers 102 and 104, which are associated with outlet zone 22. After the impingement jets of outlet zone 22 have directed refrigerant against the articles to be refrigerated, the refrigerant is drawn past upper and lower vaporizers 102 and 104 and into low pressure inlets 86 and 88 of upper and lower ejectors 74 and 76. Thereafter, the incoming refrigerant flows from upper and lower vaporizers 102 and 104, through transfer pipes 112 and 114, into a pair of upper and lower vaporizers 116 and 118 similar in design to upper and lower vaporizers 102 and 104. Upper and lower vaporizers 116 and 118 are associated with intermediate zone 24. Again, refrigerant having been expelled as impingement jets and after having heated by the articles is drawn past upper and lower vaporizers 116 and 118 and into low pressure inlets 90 and 92 of upper and lower ejectors 78 and 80. The incoming refrigerant then flows to the high pressure inlet of upper and lower pairs of ejectors 74–84 by provision of a common manifold 120. The mass flow rate of incoming refrigerant each of the pairs of ejectors is controlled by mass flow control valves 122, 124, and 126.

Although the present invention utilizes flow control valves 122–126, such valves are not the only control of flow of refrigerant to upper and lower pairs of ejectors 74–84. A direct control is provided by appropriately sizing the ejectors. Valves 122–126 provide a further flow control. It is to be noted that the present invention encompasses a control without valves that is provided by fixed flow restrictions such as orifices or appropriate sizing of ejector nozzles to obtain the desired operational control of mass flow rate of incoming refrigerant. Alternatively, the present invention encompasses the use of valves without any such sizing of orifices or ejectors.

By such an arrangement of common manifold 120 and flow control by, ejector sizing and the illustrated flow control valves 122–126, all of the motive fluid flows to upper and lower ejectors 74–84 are at the same maximum reasonable enthalpy. The vaporization of the refrigerant has increased the enthalpy of the refrigerant and such increase can be expressed as circulation work. At the same time, the temperature of the recirculated refrigerant after having been heated varies so that it is at its coldest at outlet zone 22 due to the fact that liquid nitrogen is entering upper and lower vaporizers 102 and 104 prior to flow to upper and lower vaporizers 116 and 118 associated with intermediate zone 24. Since inlet zone 26 is not provided with vaporizers, inlet zone 26 operates at the warmest temperature of any of the zones. Hence, the temperature profile is maintained which is at its coldest at outlet 22 and at its warmest at inlet 26 to minimize cryogen usage. Additionally, since the vaporizers are within the freezing chamber there is no loss of cooling capacity of the incoming liquid cryogen.

This vaporization of liquid nitrogen thus imparts an enthalpy gain to the incoming cryogen which is expressed as circulation work by ejectors 74–84. In the illustrated embodiment, as set forth above, the ejectors are sized to produce a preferred flow split in which the greatest mass flow rate occurs within the warmest zone, namely inlet zone 26. The result of this is that the impingement jets produced within inlet zone 26 can be formed with the highest velocity and therefore produce the highest heat transfer coefficient. As such, independent control of the impingement jet velocities allows the work capacity of the motive flow of incoming refrigerant to be delivered to outlet, intermediate and inlet zones 22–26 such that the overall heat transfer is maximized. Typically, a higher heat transfer coefficient needs to be obtained in zones having a lower temperature difference between the articles to be refrigerated and the temperature of the particular zone.

Figure 4:
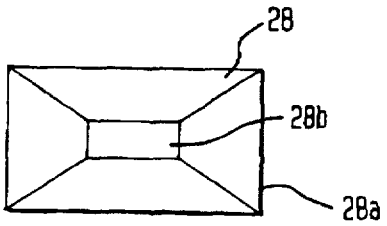
FIG. 4 is a top plan view of an impingement jet nozzle in accordance with the present invention.

As illustrated, the rows of impingement jet nozzles are staggered to provide complete coverage of the articles to be refrigerated with impingement jets. If the impingement jet nozzle elevation is compared between FIGS. 1 and FIGS. 2 it can be seen that the impingement jets narrow in two directions. With additional reference to FIG. 4 impingement jet nozzle 28 is typical of the configuration of the impingement jet nozzles. Impingement jet nozzle 28 has a proximal end **28*a* at which impingement jet nozzle 28 is attached to upper baffle 50 and an opposed distal end 28*b* defining a rectangular opening from which the impingement jet issues forth. Both proximal and distal ends 28*a* and 28*b* are rectangular. However, impingement jet nozzle 28** narrows in two orthogonal directions between proximal and distal ends 28*a* and 28*b*. This two-dimensional tapering of the impingement jet nozzles inhibits ice or frost build-up.

It should be point out that although the top and bottom impingement jet nozzles and ejectors are symmetrically arranged in the illustrated embodiment, other embodiments are possible. For instance, the lower ejectors and impingement nozzles and etc. could be eliminated. Flow in such an embodiment would be reflected off the bottom of the freezer to the articles to be refrigerated. Also, the ejectors might be sized differently with respect to their position in the freezer, for instance, the upper ejectors could be larger than the lower ejectors.

While the invention has been described with reference to a preferred embodiment, as will occur to those skilled in the art, numerous changes, additions and omissions may be made without departing from the spirit and the scope of the present invention.

We claim:

1. An impingement freezer comprising:

a freezing chamber having an inlet for receiving articles to be refrigerated and an outlet for discharging said articles after having been refrigerated;

means for conveying articles from said inlet to said outlet;

at least two zones including an inlet zone located adjacent said inlet and an outlet zone located adjacent said outlet;

each of said at least two zones having.

impingement nozzle means for directing at least one refrigerant jet against said articles to be refrigerated, and circulation means connected to said impingement nozzle means for drawing said refrigerant from said freezing chamber after having exchanged heat with said articles into a mixture with incoming refrigerant and for discharging said mixture into said impingement nozzle means to form said at least one refrigerant jet;

the circulation means driven by said at least partially vaporized incoming refrigerant;

control means for independently controlling flow rates of said incoming refrigerant to said circulation means of said at least two zones;

vaporizer means positioned within said freezing chamber to exchange heat between said incoming refrigerant and said refrigerant drawn by said circulation means of at least one of said at least two zones for at least partially vaporizing said incoming refrigerant; and distribution means connected to said heat exchange means for distributing said incoming refrigerant from said vaporization means to said control means.

2. The impingement freezer of claim 1, wherein said vaporization means comprises at least one vaporizer located within said outlet zone.

3. The impingement freezer of claim 1 or claim 2, wherein said distribution means comprises a common manifold connected to said vaporization means and said control means of each of said at least two zones.

4. The impingement freezer of claim 1, wherein said impingement nozzle means comprises an upper set of staggered rows of nozzles located above said conveying means for downwardly directing said impingement jets against said articles.

5. The impingement freezer of claim 4, wherein said impingement nozzle means also comprises a lower set of staggered rows of nozzles located below said conveying means for also upwardly directing said impingement jets against said articles.

6. The impingement freezer of claim 4 or claim 5, wherein each of said impingement nozzles has an elongated configuration, a proximal end in communication with said circulation means and a distal end from which said impingement jet issues forth, each of said impingement nozzles tapered, in two orthogonal directions from said proximal end to said distal end.

7. The impingement freezer of claim 6, wherein said proximal and distal ends have rectangular configurations.

8. The impingement freezer of claim 3, wherein said circulation means comprises at least one venturi-like device having a high pressure inlet connected to said common manifold, a low pressure inlet in communication with said freezing chamber to draw said refrigerant from said freezing chamber after having cooled said articles and having itself become heated.

9. The impingement freezer of claim 8, wherein:

each of said at least two zones has at least one compartment having an opening to said freezing chamber;

said impingement nozzle means is connected to said compartment; and said at least one venturi-like device comprises an ejector is positioned within said at least one compartment with its said low pressure inlet in registry with said opening.

10. The impingement freezer of claim 9, wherein said control means comprise a flow control valve interposed between said common manifold and said high pressure inlet to said ejector.

11. The impingement freezer of claim 3, wherein:

said at least two zones include an intermediate zone situated between said entry and outlet zones; and said vaporization means include at least two vaporizers positioned within said outlet and intermediate zones and connected in series so that said incoming refrigerant flows to said outlet zone, said intermediate zone and then, to said common manifold.

12. An impingement freezer comprising:

a freezing chamber having an inlet for receiving articles to be refrigerated and an outlet for discharging said articles after having been refrigerated;

means for conveying articles from said inlet to said outlet; and a plurality of nozzles for directing jets of refrigerant against said articles to be refrigerated, each of said nozzles comprising an elongated body having a proximal end and a distal end located opposite to said proximal end, said elongated body being tapered in two, transverse cross-sectional orthogonal directions from said proximal end to said distal end and said proximal and distal ends having a rectangular configuration.

13. An impingement freezer comprising:

a freezing chamber having an inlet for receiving articles to be refrigerated and an outlet for discharging said articles after having been refrigerated;

means for conveying articles from said inlet to said outlet;

at least a first plurality of impingement nozzles for directing refrigerant jets against said articles to be refrigerated, at least one ejector having a high pressure inlet for receiving an incoming refrigerant stream, a low pressure inlet for drawing said refrigerant from said freezing chamber after having exchanged heat with said articles into a mixture with incoming refrigerant and a high pressure outlet for discharging said mixture into said impingement nozzle; and vaporization means in communication with said high pressure inlet of said at least one ejector for at least partially vaporizing said incoming refrigerant and for discharging said incoming refrigerant stream to said ejector;

said vaporization means positioned in said freezing chamber, between said articles and said low pressure inlet so that said refrigerant after having cooled said articles and having itself become heated, transfers heat to said incoming refrigerant before being drawn into said mixture.

14. The impingement freezer of claim 13, wherein each of said impingement nozzles has an elongated configuration, a proximal end in communication with said circulation means and a distal end from which said impingement jet issues forth, each of said impingement nozzles tapered, in two orthogonal directions from said proximal end to said distal end 14.

15. The impingement freezer of claim 12 or claim 14, wherein said impingement nozzles are arranged in staggered rows.

16. The impingement freezer of claim 14, wherein said proximal and distal ends each have a rectangular configuration.

17. A method of refrigerating articles comprising:

passing said articles through a freezing chamber in a direction taken from an inlet to an outlet of said freezing chamber;

directing impingement jets of refrigerant against said articles so that said refrigerant warms to form heated refrigerant and said articles cool through direct heat transfer between said refrigerant and said articles;

said impingement jets being directed against said articles in at least two zones of said refrigeration chamber including an inlet zone adjacent said inlet of said freezing chamber and an outlet zone adjacent said outlet of said freezer;

at least partly vaporizing incoming refrigerant through heat transfer with said heated refrigerant;

delivering at least first and second portions of said incoming refrigerant after having been at least partly vaporized to said outlet and inlet zones, respectively;

drawing said heated refrigerant from said inlet and outlet zones by expending work from said at least partly vaporized incoming refrigerant;

mixing said heated refrigerant with said first and second portions of said incoming refrigerant; and forming said impingement jets of said outlet and inlet zones from mixtures of said heated refrigerant and said first and second portions of said incoming refrigerant, respectively.

18. The method of claim 17, wherein said incoming refrigerant is partly vaporized in said outlet zone.

19. The method of claim 17, wherein:

said at least two zones also include an intermediate zone located between said entry and outlet zones;

said heated refrigerant is drawn from said intermediate zone, mixed with a third part of said incoming refrigerant after having been at least partly vaporized to produce a third mixed refrigerant stream and said impingement jets associated with said intermediate zone are formed from said third mixed refrigerant stream;

said incoming refrigerant is at least partly vaporized through initial indirect heat transfer within said outlet zone and then through indirect heat transfer within said intermediate zone with said heated refrigerant being drawn into said mixtures with said incoming refrigerant and such that said outlet zone has a lower temperature than said intermediate zone and said entry zone has a higher temperature than said intermediate zone.

* * * * *